US007553507B2

(12) United States Patent
Matthews

(10) Patent No.: US 7,553,507 B2
(45) **Date of Patent: *Jun. 30, 2009**

(54) CORN DEBRANNING AND DEGERMINATION PROCESS

(75) Inventor: Peter Matthews, Houston, TX (US)

(73) Assignee: Satake USA, Inc., Stafford, TX (US)

( * ) Notice: Subject to any disclaimer, the term of this patent is extended or adjusted under 35 U.S.C. 154(b) by 730 days.

This patent is subject to a terminal disclaimer.

(21) Appl. No.: 11/147,871

(22) Filed: Jun. 8, 2005

(65) Prior Publication Data

US 2005/0226978 A1 Oct. 13, 2005

Related U.S. Application Data

(63) Continuation-in-part of application No. 10/004,742, filed on Dec. 4, 2001, now Pat. No. 6,936,294.

(51) Int. Cl.
*B02B 5/02* (2006.01)

(52) U.S. Cl. ..... 426/481; 426/483; 426/507

(58) Field of Classification Search ..... 426/483, 426/507, 481; 241/6, 7, 9
See application file for complete search history.

(56) References Cited

U.S. PATENT DOCUMENTS 3,088,827 A 5/1963 Kaufman
3,104,692 A 9/1963 Davis et al.
4,066,012 A 1/1978 Satake et al.
4,181,748 A 1/1980 Chwalek et al.
4,301,183 A 11/1981 Giguere
4,522,837 A 6/1985 Meinardus
5,073,201 A 12/1991 Giesfeldt et al.
5,250,313 A 10/1993 Giguere
5,678,477 A 10/1997 Satake et al.
6,254,914 B1 7/2001 Singh et al.
6,936,294 B2 * 8/2005 Matthews et al. ..... 426/483

* cited by examiner

*Primary Examiner*—Anthony Weier
(74) *Attorney, Agent, or Firm*—James E. Hudson, III; Crain, Caton & James, P.C.

(57) ABSTRACT

The present invention provides a process to remove the bran and the germ from the endosperm of a corn kernel. The process includes use of an apparatus having a chamber to induce rubbing between adjacent corn kernels to remove bran and an apparatus for germ removal having frictional cylindrical rollers rotating substantially parallel to one another, in opposing directions, and tensioned to impart low-impact friction forces to each corn kernel drawn between the roller surfaces. The process of the present invention includes a tempering step including adding an amount of moisture to the bran of the corn kernel by wetting and soaking the corn kernel; a bran removal step for removing substantially all bran from the corn by rubbing corn kernels together; a second tempering step including adding an additional amount of moisture to the exposed germ by wetting and soaking the exposed germ; and a degermination step to fracture the endosperm about the germ, substantially freeing the germ from the endosperm.

15 Claims, 3 Drawing Sheets

CORN DEBRANNING AND DEGERMINATION PROCESS

CROSS-REFERENCE TO RELATED APPLICATIONS

This is a continuation-in-part of U.S. patent application Ser. No. 10/004,742, now U.S. Pat. No. 6,936,294, filed Dec. 4, 2001.

STATEMENT REGARDING FEDERALLY SPONSORED RESEARCH OR DEVELOPMENT

Not Applicable.

BACKGROUND OF THE INVENTION

1. Field of the Invention

This invention relates generally to corn milling and more particularly to improved processes for debranning and degermination of corn.

2. Description of the Related Art

Corn milling processes separate corn into various components of the kernel. In a wet-milling process, the corn is steeped in an aqueous solution to soften the kernel and ground to free the germ. Aqueous processes are described in U.S. Pat. No. 5,073,201 to Gisfeldt et al. In a dry-milling process, the corn kernel is separated into the endosperm, germ and other fibers (referred to as a hull or bran layer) in a dry or slightly moistened condition.

One of the necessary steps in the dry corn milling process, whether the milled product is to be used for the production of ethanol, starch, flakes, grits or flour, involves separation of the bran and the germ (also referred to as embryo) from the endosperm, which is then processed further to produce the milled corn product.

In a typical dry milling process, corn kernels are cleaned to remove extraneous material. The cleaned corn is tempered with water or steam then passed through a degerminating mill to release the bran from the germ and endosperm.

Traditionally, germ has been removed from corn kernels during milling through the use of a "Beall" type degerminator. In the Beall type of degerminator, corn is fed into and through the annulus formed between a rotating, conical rotor and a stationary concentric screen made of perforated metal. Both rotor and screen are textured with large nodes, which impede motion of the kernels as they turn with the rotor. A weighted discharge plate provides a method of controlling pressure and corn density within the chamber. In this process, the germ is dislodged from the endosperm by impact and bending stress as the kernels move through the annulus. In practice, most of the kernels are broken during the process. Typically, this process produces an effective recovery of endosperm particles of which approximately twenty to thirty percent of the endosperm pieces will be retained on a No. 6 standard sieve cloth. Because a significant portion of the bran may still adhere to the pieces of endosperm after the degermination process, further refinement of the endosperm may be required to reduce the fiber content of the endosperm product.

Inherent inefficiencies in refining and recovery processes result in increased processing costs and a reduction in the overall yield of low fat corn products.

For any of the milled corn products, the production of low fat products is desirable. In general, it is desirable during the degermination stage of the corn milling process to produce large particles of endosperm that are largely free of bran and germ. Though the degermination process can be destructive to the corn kernels, it is generally desirable to minimize the production of fine particles of endosperm, as the fine particles are difficult to separate from the bran and germ particles in order to recover them as a corn product. Maximizing the production of large particles of endosperm thus offers maximum yields of corn products and improves the quality of the products.

U.S. Pat. No. 5,250,313 to Giguere (a continuation-in-part of U.S. Pat. No. 4,189,503) describes a degerminating process wherein the corn kernels are crushed from the thin edges toward the center while avoiding crushing of the relatively flat side surfaces. The crushing force fractures the endosperm under and around the germ and squeezes the germ away from the endosperm. A machine for carrying out the degermination includes relatively rotating discs having corrugations in their facing surfaces in which the kernels are caught and crushed from the thin edges toward the center. An alternative degerminator machine includes a single rotating disc having curved guide vanes on its upper surface for guiding the kernels as they are propelled outwardly by centrifugal force.

U.S. Pat. No. 6,254,914 describes a wet-milling process for recovery of corn coarse fiber (pericarp) including the steps of: soaking corn in water to loosen the attachments of various corn components therein to each other, degerminating the soaked corn to strip the corn coarse fiber and the germ away from the endosperm, recovering the germ, and recovering the corn coarse fiber by flotation. The degerminating step of such process involves grinding the kernels in a degermination mill such as a Bauer mill so that the pericarp and germ are stripped away from the endosperm.

U.S. Pat. No. 4,181,748 to Chwalek, et al. describes a combined dry-wet milling process for refining corn comprising dry milling corn kernels to provide an endosperm fraction, a germ fraction, a fiber (hull) fraction and a cleanings fraction, wet milling the endosperm fraction including using two distinct steeping steps, one upstream and the other downstream of an impact milling step, to provide a mill starch slurry. The process further comprises removing fine fiber tailings from the mill starch slurry, separating the slurry into a starch-rich fraction and protein-rich fraction, concentrating the protein-rich fraction, directly combining the fiber (hull), cleanings, fine fiber tailings and protein-rich concentrate without removing corn oil therefrom, with the germ fraction to provide a wet animal feed product, and drying the feed product.

U.S. Pat. No. 4,301,183 to Giesfeldt et al. discloses a method and apparatus for degerminating a corn kernel by impelling the kernels along a guide vane into an impact surface including a horizontal disc having a plurality of guide vanes extending in a curvilinear path with each vane terminating in an end portion that is substantially parallel to a tangent to the disc. A plurality of impact surfaces are provided in the same horizontal plane as the disc with each surface being substantially linear and extending transversely of the path of travel of a kernel impelled by the disc.

The prior art processes result in a high percentage of fine particles of endosperm that are difficult to separate from the bran and germ particles in order to recover them as a corn product. Cylindrical, rubberized rollers have been used to remove hulls from other grains, particularly rice. Rollers for removing hulls from grains are described in U.S. Pat. No. 3,104,692 to Davis et al. dated Sep. 24, 1963, U.S. Pat. No. 4,066,012 to Satake and U.S. Pat. No. 5,678,477 to Satake et al. Despite the use of such rollers for removing hulls from grains and the long-standing need to separate corn germ from endosperm with a minimum amount of fine endosperm particles, the use of rubberized rollers and the process of the present invention have not been previously practiced.

BRIEF SUMMARY OF THE INVENTION

Accordingly, it is an object of the present invention to provide a process for increasing the production of large particles of bran, endosperm, and germ and thus maximize yields of low-fat corn products and improve the value of the products.

The present invention provides a process to remove the bran from the corn kernel, and the germ from the endosperm of a corn kernel. The process includes use of an apparatus having a chamber to induce rubbing between adjacent corn kernels to remove bran and use of a structure for germ removal having frictional cylindrical rollers rotating substantially parallel to one another, in opposing directions, and tensioned to impart low-impact friction forces to each corn kernel drawn between the roller covers. The process of the present invention includes a tempering step comprising adding an amount of moisture to the bran of the corn kernel by wetting and soaking the corn kernel; a bran removal step for removing substantially all bran from the corn by rubbing corn kernels together; a second tempering step comprising adding an additional amount of moisture to the germ by wetting and soaking the exposed germ; and a degermination step to fracture the endosperm about the germ, substantially freeing the germ from the endosperm while maintaining large particle of endosperm and germ.

DETAILED DESCRIPTION OF THE INVENTION

Figure 2:
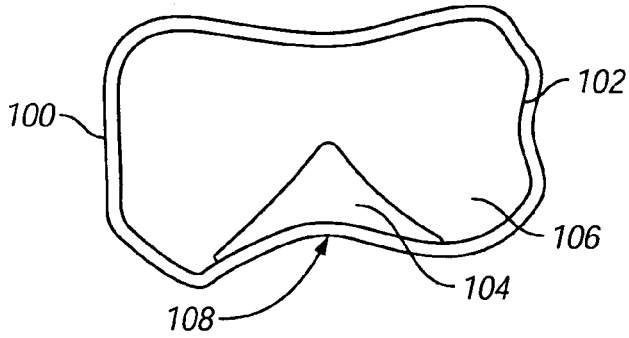
FIG. 2 depicts a cross-sectional top view of a corn kernel with the bran in place.
Figure 3:
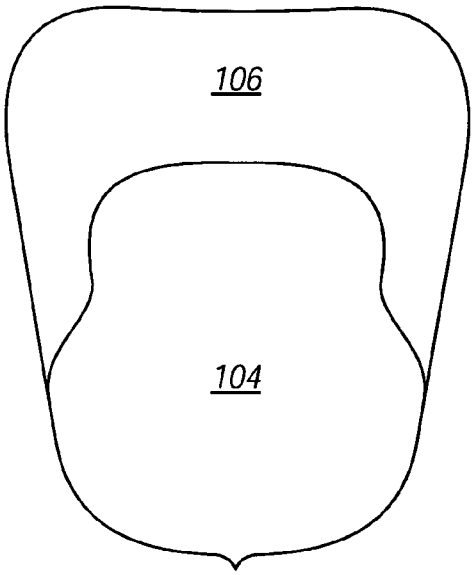
FIG. 3 depicts a front view of a corn kernel with the bran removed.
Figure 4:
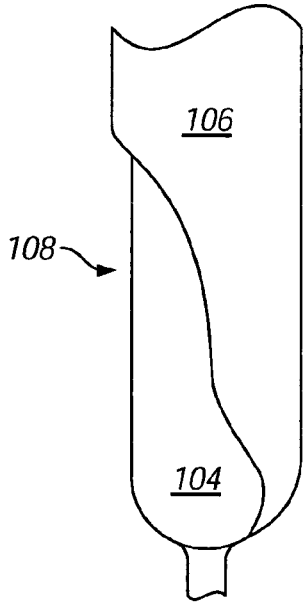
FIG. 4 depicts a side view of a corn kernel with the bran removed.

Referring first to FIGS. 2, 3, and 4 a corn kernel 100 is depicted for reference as to terms used herein. A typical corn kernel 100 includes a germ 104 and an endosperm 106 that are totally covered in a casing of bran 102. The germ 104 is embedded in one of the large, relatively flat sides 108 of kernel 100.

Figure 1:
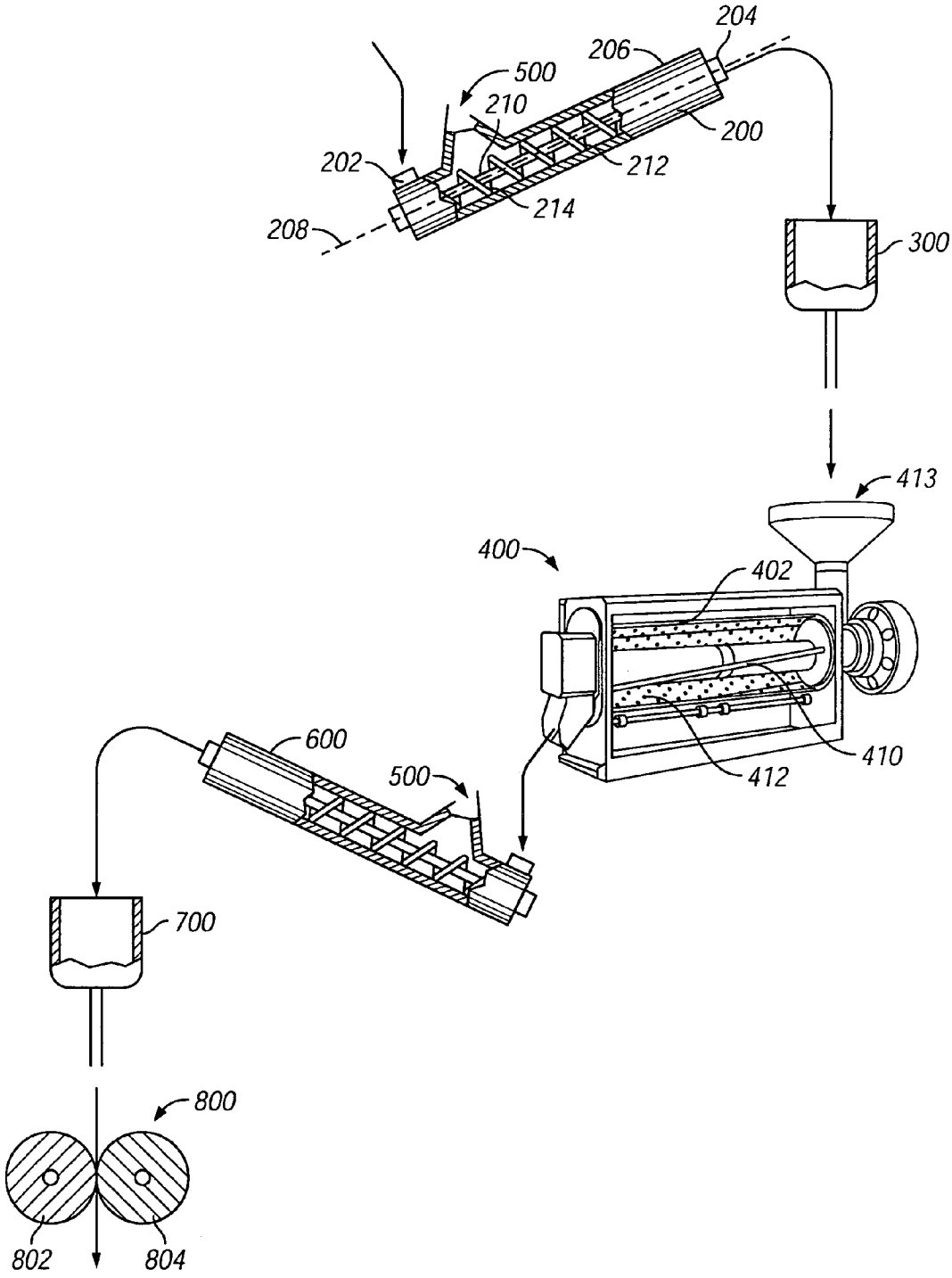
FIG. 1 depicts a schematic diagram of a debranning and degermination process incorporating the process of the present invention.

Referring to FIG. 1, the process of the present invention is depicted as a process flow diagram. In the process of the present invention a measured amount of raw, clean corn kernels are first tempered. Such tempering is well-known in the art. In the preferred embodiment, the corn kernels are first introduced into a first tempering machine 200 where a measured amount of water 500 is added. The water 500 may be in various forms including water, steam or an aqueous solution. In the preferred embodiment, the first tempering machine 200 comprises a generally cylindrical housing 206 having a central axis 208 and a co-axial auger 210. The auger 210 comprises a rotating shaft 212 having angled paddles 214, the angled paddles 214 transmitting the corn kernels (not shown) from a inlet end 202 of the tempering machine 200 to a outlet end 204 of the first tempering machine 200. The rotating auger 210 distributes the water 500 on the corn kernels for complete wetting of the corn kernels to provide for even penetration of moisture. Tempering machines 200 are commonly used in the industry to provide uniform wetting of corn kernels. A suitable, commercially available tempering machine is manufactured and sold by the Satake Corporation and identified as a Technovator, model STMA. The corn kernels are then transferred to a holding tank 300 where they are retained until the kernels obtain a desired level of moisture absorption, a process referred to as tempering. This tempering softens and expands the bran 102, but does not last so long as to provide significant penetration of water 500 in the germ 104 or endosperm 106. Such moisturization makes the bran 102 more pliable, and weakens the bond between the wetted bran 102 and the less-absorbent germ 104 and endosperm 106, allowing the bran to be removed without substantially disturbing the germ 104 or the endosperm 106.

Holding time in the holding tank 300 is typically three (3) to fifteen (15) minutes, depending on the variety of corn and the desired level of moisturization. In an exemplary embodiment the corn kernels are handled in a first-in, first-out basis and adding about 5% water by weight is sufficient moisturization. The invention allows for a varied range of moisture levels as needed in the resulting products for optimizing intended further processing.

Figure 5:
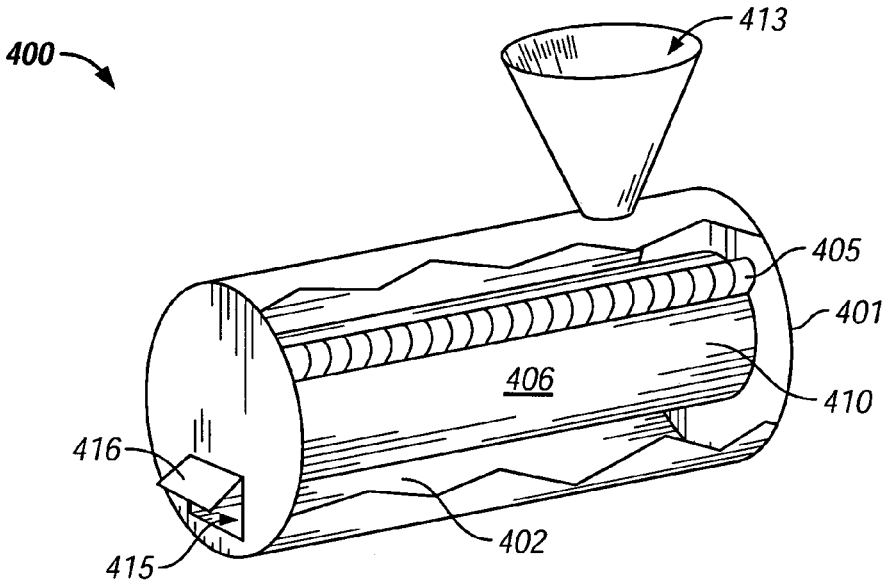
FIG. 5 depicts the debranning apparatus.

In the process of the present invention, the tempered corn kernels are next introduced into a debranning machine 400. Referring to FIG. 5, debranning machine 400 contains a chamber 401 wherein the corn kernels are induced to rub against each other. The chamber 401 where rubbing is induced includes at least one side 402. Rubbing between corn kernels is induced over sufficient time and with sufficient force to cause substantially all bran to separate from the endosperm of the corn kernel. Sufficient force may be imparted to the corn kernels by compression within chamber 401. Rubbing may be caused by imparting movement to the corn kernels by oscillation of the chamber or by movement of the corn kernels within the chamber. Such oscillations within the chamber may be accomplished by use of direction of low frequencies sound waves into the corn or by induced movement of the corn kernels within chamber 401 by one or more agitators. In the preferred embodiment the debranning machine consists of a rotating cylindrical rotor 410, having a surface 406 having one or more compression-inducing surface protuberances 405 surrounded by abrasive side 402, side 402 composed of 5 or more equilateral panels, wherein the corn kernels are introduced through an opening 413. Surface protuberances 405 may be longitudinal to the surface and parallel to the axis of rotating cylindrical rotor 410 or may be skewed to the axis of rotating cylindrical rotor 410 along surface 406. Successive introduction of corn kernels generally moves previously introduced corn kernels toward passage 415, which permits exiting of debranned corn kernels. Passage 415 may be hingely gated by a gate 416 adjusted to permit exiting of debranned corn kernels upon application of sufficient force exerted on gate 416 by corn kernels within machine 400. The extent of debranning may be controlled by adjustment of the force necessary to open gate 416. In operation, as the clearance between the side 402 and the rotor 410 changes during each rotation, the corn kernels experience sufficient compression to produce an effective rubbing action which removes the bran from the corn kernel. Additionally, in the preferred embodiment, side 402 is composed of six equilateral panels which, by virtue of the non-circular shape, create concentrations of the compression and well as areas in which corn kernels are not in compression. The rate of debranning may also be adjusted by selection of the coefficient of friction associated with side 402. Faster debranning may be accomplished by use of a side 402 with a higher coefficient of friction. In the preferred embodiment, shown in FIG. 1, side 402 may be perforated to permit loose bran to exit chamber 401 through perforations 412 in side 402 by gravity or by atmospheric flow. In such embodiment, the remove loose bran is of a small surface area, typically referred to as fines. Larger loose bran, typically referred to as coarse, is typically removed downstream of the debranning machine.

A quantity of bran 102 remains attached to the corn kernel 100 after the debranning step. The remaining bran 102 is usually attached to the pointed end of the germ 104. The amount of bran 102 left on the germ 104 can be controlled and may be varied in relation to the desired end product from the processing. A controlled amount of bran still attached to the germ 104 is desired to assist in frictional removal of the germ 104 from the endosperm 106, and to increase the moisture content of the finished product (germ 104, with a small percentage of bran 102). The processor can use the amount of bran 102 left on the germ 104 to control the process and the finished product.

In the process of the present invention the germ of the debranned corn kernels is then tempered. Once desired amount of bran 102 is removed from the corn kernel 100, a controlled amount of moisture is added to the germ with a second tempering machine 600, as previously done in the tempering machine 200. During this period, moisture swells the germ 104, which absorbs the moisture more quickly that the endosperm 106, and loosens the bond between the germ 104 and the endosperm 106. The holding time may vary depending on the amount of moisture absorption required, but should not be of such duration to permit breaking down of the inter-cellular bonds of the starch of the endosperm 106, as such break down promotes breakage of the endosperm 106.

Figure 6:
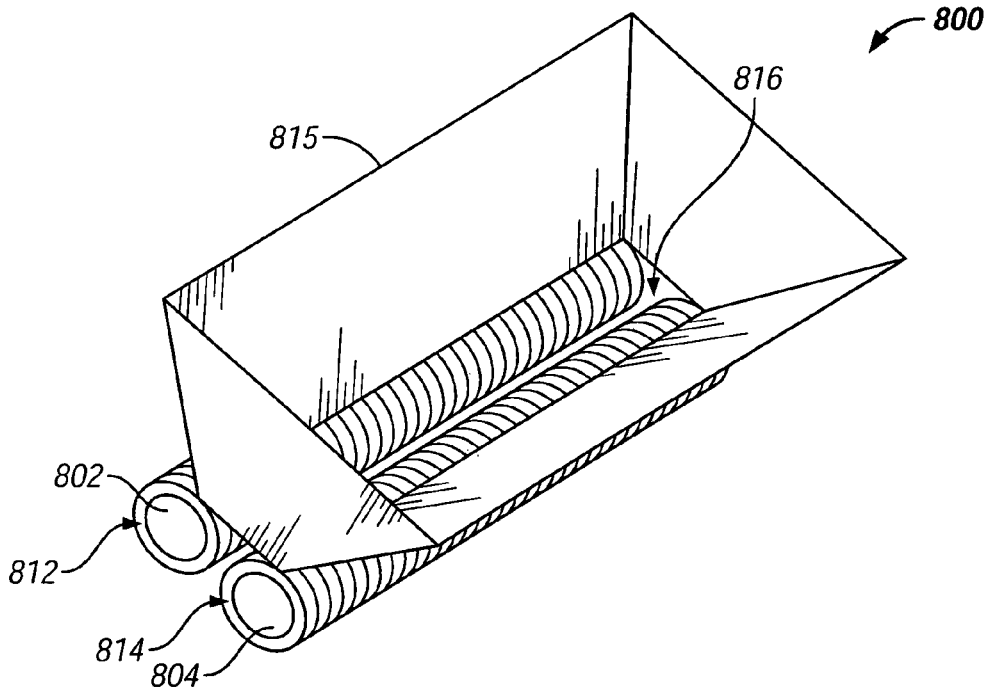
FIG. 6 depicts the roller portion of the degermination apparatus.

In the process of the present invention a substantial amount of germ is freed from the debranned and germ-tempered corn kernels. Referring to FIG. 6, the debranned corn kernels are then fed into the degermination machine 800. In the preferred embodiment, degermination machine 800 includes a tempering apparatus 600, two cylindrical rollers 802 and 804 with a hopper 815 located above cylindrical rollers 802 and 804 and having with a passage 816 at the bottom of hopper 815. Alternatively, degerminating machine 800 may be operable using a plurality of pairs of rollers (not shown). In the preferred embodiment, passage 816 runs the length of rollers 802 and 804 and is sufficiently wide to communicate with rollers 802 and 804 at their upper quadrants where the surface 812 and 814 respectively are moving downward. In alternative embodiment (not shown) passage 816 is sufficiently wide to communicate with one or more rollers. In the preferred embodiment, cylindrical roller 802 is surrounded by a surface 812 of rubber, polyurethane or other material having suitable elastic properties. Likewise in the preferred embodiment cylindrical roller 804 is surrounded by a surface 814 of rubber, polyurethane or other material having suitable elastic properties. In the preferred surfaces 812 and 814 are of same elastic material. Alternatively (not shown), surfaces 812 and 814 may have an inelastic material having sufficient surface texture to create sufficient friction between rollers 802 and 804 to draw corn kernels from one side of rollers 802 and 804 to the other. Inelastic rollers without sufficient surface text will reject the corn kernels, ultimately thrusting the corn kernels upward rather than through the rollers. In a further alternative embodiment (not shown), surface 812 may have an elastic surface while surface 814 may be an inelastic textured surface. In all embodiments roller surfaces must have a sufficient coefficient of friction to engage the debranned corn kernels 100 while the force applied to the debranned corn kernels by the rollers must be insufficient to substantially crack or crush the debranned corn kernels 100. A stiff rubber or relatively dense polyurethane has been determined to have characteristics consistent with such requirement. In the preferred embodiment having two rollers, the two rollers 802 and 804 rotate in different directions, so the adjacent surfaces move the same direction. In the preferred embodiment, rollers 802 and 804 rotate at different speeds. Because friction mandates that an object in contact with either roller 802 or 804 will attempt to move at the same linear speed as the surface of the roller, a shear force develops across the debranned corn kernel 100, from the difference in linear speed applied to the two different sides of the debranned corn kernel 100. This action causes fracturing of the endosperm 106 about the germ 104, substantially freeing the germ 104 from the endosperm while producing large particles of endosperm 106 and a minimal number of such particles.

At least one of the rollers 802 or 804 is adjustable in relationship to the other so that the friction applied between the roller surfaces may be adjusted to provide sufficient friction to various size corn kernels to fracture endosperm 106, substantially free germ 104, but to avoid pulverizing the kernel 100.

The adjustability of inter-roller friction may be accomplished by varying the differential tangential velocity of the rollers, varying the gap between the rollers, tensioning the distance between the rollers with springs, pneumatic pistons or other tensioning device. Interactive assessment of the applied friction may be accomplished by monitoring the amperage drain of the roller motors, the air pressure in a pneumatic piston, the amperage of the air pressure production pump feeding the pneumatic piston, or other means.

In practice, the application of such friction will result in fracturing endosperm 106 about germ 104, and in tearing of the endosperm 106, resulting in endosperm 106 particles. By minimizing the production of fine particles and by maximizing the size of particles produced, the highest value of the kernel may be realized. Endosperm 106 particles produced as a result of process of the present invention tend to be relatively large as such particles are produced as a result of a shear force rather than an impact force.

Germ 104 maintained in its whole state provides greater oil production. Endosperm 106 maintained in large particle state is suitable for high value end-product uses.

The resulting mixture of germ 104 and endosperm 106 may be separated by various methods known in the art.

The process of this invention is further illustrated in the following example.

EXAMPLE

In the first step, water is added to a fixed quantity of whole corn kernels. The wetted corn kernels are allowed to rest for ten minutes prior to being introduced to a Mist Polisher (Model KB40G) at a controlled feed-rate of 6000 pounds per hour.

With a 2 mm.times.15 mm slotted screen installed in the polisher, two distinct stock separations—overtails and throughs—are generated. The overtails, referring to the product not allowed to pass through the 2 mm.times.15 mm screen, consist of whole corn kernels (endosperm and germ) and is relatively bran free. Overtails constitute 82.5% of the processed corn. The germ of the corn is still largely intact within the endosperm. The overtails pass to the second tempering stage. The throughs, referring to the product that passes through the 2 mm.times.15 mm screen, constitute 17.5% of the processed corn.

Analysis of the throughs shows that the 17.5% of the total corn stock consists of coarse bran, fine bran and pieces of endosperm grit. Sifting and aspiration would separate the majority of the endosperm grit from the bran, so that the recovered endosperm may go on to conventional purification and reduction, and ultimately become a useful end-product; however, further sifting and aspiration processes are not conducted in the present example.

After being separated, the overtails are again tempered by wetting the corn kernels in a tempering machine and then allowing them to rest in a holding tank. Up to 6% water by weight is added in about eight minutes of tempering. Next, the overtails are processed through rubber rollers. A tempered sample is fed into the rubber rollers and the roll friction adjusted to an optimum grind pressure for the particular corn batch.

The gap distance between the rollers is set so as to produce minimal breakage in the sample. The remaining overtails are then processed at that setting.

Analysis of the output from the rubber rollers indicate that the resulting product, as a percentage of total corn stock, is 7.10% large germ pieces, 2.66% large pieces of endosperm grit with adhering germ fragments, and 72.70% endosperm grit without adhering germ fragments. Passing the endosperm grit through a sifter having various sizes of mesh showed 58.66% of the total corn stock comprises endosperm grit that remains above a #6 Wire (3530 micron) mesh sifter.

The 7.10% large germ pieces consists of a high percentage of whole germs, which are ideal for efficient operation of further processing systems.

The 2.66% large pieces of endosperm grit with adhering germ may be retreated through the rubber roller friction process or diverted through an independent friction unit, depending on the capacity requirements of the user; however, such steps are not undertaken in the present example. Either step would result in separating additional clean endosperm grit from the germ fragments.

The foregoing disclosure and description of the invention is illustrative and explanatory thereof. Various changes in the details of the illustrated process may be made within the scope of the appended claims without departing from the spirit of the invention. The present invention should only be limited by the following claims and their legal equivalents.

What is claimed is:

1. A process for debranning and de-germinating corn kernels, said corn kernels each having bran, an endosperm and germ, said corn kernel having sides and thickness, said endosperm having a surface, an inside edge, said germ having an outer edge, comprising, in the sequence indicated:

a first tempering step;

a debranning step, said debranning step comprising inducing said corn kernels to rub against one another with sufficient force to rub a substantial portion of said bran from the surface of said endosperm a second tempering step; and a degerminating step, said degerminating step comprising applying force to opposing sides of each of said kernels, said force applied by drawing each of said corn kernels between at least one pair of two spaced-apart counter-rotating rollers, each of said two spaced-apart counter-rotating rollers having a surface with a sufficient coefficient of friction to draw said corn kernel from one side of said two spaced-apart counter-rotating rollers to the other side of said two spaced-apart counter-rotating rollers, said two spaced-apart counter-rotating rollers spaced less than one corn kernel thickness apart, whereby said endosperm of said kernel is fractured about said germ, substantially freeing said germ from said endosperm by application of force between said inside edge of said endosperm and said outer edge of said germ.

2. The process as in claim 1 wherein at least one of said pair of said spaced-apart counter-rotating rollers has an elastic surface.

3. The process as in claim 2 wherein: said elastic surface comprising a rubber surface.

4. The process as in claim 2 wherein: said elastic surface comprising a polyurethane surface.

5. The process as in claim 4 wherein: said opposing rotating cylinders operable at differing tangential velocities.

6. The process as in claim 5 wherein: at least one of said opposing rotating cylinders adjustable in relation to the other said opposing rotating cylinder for adjustment of the friction forces applied to said corn kernels.

7. The process as in claim 1 wherein: said first tempering step including wetting said corn kernels and soaking said corn kernels for a sufficient soaking period of time to allow penetration of wetting solution to soften and expand said corn kernel bran.

8. The process as in claim 7 wherein: said first tempering step terminating prior to substantial penetration of wetting solution in said corn kernel endosperm or said corn kernel germ.

9. The process as in claim 7 wherein: said soaking period of time lasting from three to fifteen minutes.

10. The process as in claim 1 wherein: said second tempering step comprising wetting said germ of said corn kernels and soaking said germ of said corn kernels to soften and expand said corn kernel germ.

11. The process as in claim 10 wherein: said second tempering terminating prior to absorption of sufficient wetting solution in said corn kernel endosperm to break down cellular bonds within a starch structure of said endosperm.

12. A process for de-branning and de-germinating corn kernels, each of said corn kernels having bran, an endosperm and a germ, each of said corn kernels having an outer surface, said bran having a surface, comprising, in the sequence indicated:

a first tempering step including wetting said outer surface of said corn kernels for a sufficient period of time to allow penetration of said bran by a wetting solution to soften and expand said corn kernel bran without substantial penetration of wetting solution to said corn kernel endosperm;

a debranning step for removing said bran from said corn kernels, said debranning step comprising cyclically compressing said corn kernels within a chamber having an abrasive wall and inducing said corn kernels to rub against one another or against said abrasive wall with sufficient force to rub a substantial portion of said bran from said surface of said endosperm;

a second tempering step comprising wetting said germ of said debranned corn kernels and soaking said corn kernels to soften and expand said germ without absorption of sufficient wetting solution in said endosperm to break down cellular bonds within a starch structure of said endosperm;

and a degermination step comprising applying forces to said corn kernels between at least one pair of rollers, said pair of rollers spaced less than one corn kernel thickness apart, said rollers counter-rotating with respect to each other, said rollers each of said rollers having a surface with a sufficient co-efficient of friction to draw each of said corn kernels from one side of said at least one pair of spaced-apart counter-rotating rollers to the other side of said pair of said spaced-apart counter-rotating rollers, said rollers fracturing said endosperm about said germ, substantially freeing said germ from the endosperm by application of force between said inside edge of said endosperm and said outer edge of said germ.

13. The process as in claim 12 wherein: said at least one pair of at least two rollers having surfaces of opposing rotating cylinders; said opposing rotating cylinders operable at differing tangential velocities; and at least one of said opposing rotating cylinders adjustable in relation to the other said opposing rotating cylinder for adjustment of the friction forces applied to said corn kernels.

14. The process as in claim 12 wherein: said first tempering step soaking period of time lasting from three to fifteen minutes.

15. The process as in claim 12 wherein: a separating step after said degermination step for separating said germ from said corn kernels.

* * * * *